US011333016B2

(12) United States Patent
Jin et al.

(10) Patent No.: US 11,333,016 B2
(45) Date of Patent: May 17, 2022

(54) ULTRASONIC TRANSDUCER FOR MEASURING WELLBORE CHARACTERISTICS

(71) Applicant: Halliburton Energy Services, Inc., Houston, TX (US)

(72) Inventors: Jing Jin, Singapore (SG); Yao Ge, Singapore (SG); Xiang Wu, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 199 days.

(21) Appl. No.: 16/749,544

(22) Filed: Jan. 22, 2020

(65) Prior Publication Data

US 2021/0222551 A1 Jul. 22, 2021

(51) Int. Cl.

| | |
|---|---|
| ***E21B 49/00*** | (2006.01) |
| ***E21B 47/00*** | (2012.01) |
| ***B06B 1/02*** | (2006.01) |
| ***B06B 1/06*** | (2006.01) |
| ***E21B 47/002*** | (2012.01) |

(52) U.S. Cl.

CPC ..... *E21B 49/00* (2013.01); *B06B 1/0215* (2013.01); *B06B 1/0662* (2013.01); *E21B 47/002* (2020.05); *B06B 2201/73* (2013.01)

(58) Field of Classification Search

CPC ..... E21B 49/00; E21B 47/002; B06B 1/0215; B06B 2201/73; B06B 2201/40; B06B 2201/55; B06B 1/0622; B06B 1/067

USPC ..... 367/87

See application file for complete search history.

(56) References Cited

U.S. PATENT DOCUMENTS

| | | | |
|---|---|---|---|
| 4,672,591 | A | 6/1987 | Breimesser et al. |
| 5,343,443 | A | 8/1994 | Merewether |
| 7,199,509 | B2 | 4/2007 | Kuniyasu et al. |
| 7,513,147 | B2 | 4/2009 | Yogeswaren |
| 8,232,705 | B2 | 7/2012 | Tai |

(Continued)

FOREIGN PATENT DOCUMENTS

GB 2355528 A 4/2001

OTHER PUBLICATIONS

Cegla, et al., "High temperature (> 500° C.) wall thickness monitoring using dry coupled ultrasonic waveguide transducers", Department of Mechanical Engineering Imperial College London, Oct. 15, 2010, 48 pages.

*Primary Examiner* — Daniel L Murphy
(74) *Attorney, Agent, or Firm* — Kilpatrick Townsend & Stockton LLP

(57) ABSTRACT

An ultrasonic transducer positionable in a wellbore environment may include a piezoelectric material layer, a protective layer, and connecting plate positioned between the piezoelectric material layer and the protective layer. The piezoelectric material layer may be formed as a plurality of columns of piezoelectric material for detecting a characteristic of the wellbore environment during a drilling operation. The protective layer may be positionable between the piezoelectric material layer and an acoustic medium in the wellbore environment. The connecting plate may be positioned between the piezoelectric material layer and the protective layer. The connecting plate may have a coefficient of thermal expansion (CTE) in a range between the CTE of the piezoelectric material layer and that of the protective layer, and an acoustic impedance in a range between the acoustic impedance of the piezoelectric material layer and that of the protective layer.

18 Claims, 8 Drawing Sheets

(56) References Cited

U.S. PATENT DOCUMENTS

| | | | |
|---|---|---|---|
| 8,288,920 | B2 | 10/2012 | Mueller et al. |
| 8,698,378 | B2 | 4/2014 | Mueller et al. |
| 9,050,628 | B2 | 6/2015 | Lautzenhiser et al. |
| 9,308,554 | B2 | 4/2016 | Campbell et al. |

Measured signals of conventional transducer at various temperatures

ULTRASONIC TRANSDUCER FOR MEASURING WELLBORE CHARACTERISTICS

TECHNICAL FIELD

The present disclosure relates generally to sensors for measuring characteristics of a wellbore and, more particularly (although not necessarily exclusively), to an ultrasonic transducer for measuring characteristics of a wellbore in a drilling operation.

BACKGROUND

A well system (e.g., oil or gas wells for extracting fluids from a subterranean formation) can include various devices. For example, a well system can include a downhole logging tool, such as a measuring-while-drilling ("MWD") tool or a logging-while-drilling ("LWD") tool, for measuring or otherwise determining various properties of the subterranean formation from within a wellbore. The downhole logging tool can generate signals to measure characteristics of a wellbore, for example, the internal diameter of a casing, tubing or open borehole using high-frequency acoustic signals.

An ultrasonic transducer can be used in the downhole logging tool to perform wellbore measurements during or after drilling operations. Wellbore temperatures (and the acoustic medium in which the ultrasonic transducer must operate) can reach temperatures in a range of 200° F. to 300° F. (95° C. to 150° C.) or higher. While a protective layer is used to protect the transducer, as temperature increases, epoxy bonding between the piezoelectric material and the protective layer is subject to high thermal stress due to large differences between the coefficient of thermal expansion (CTE) of the piezoelectric material and the protective layer. Ultrasonic transducers operated in wellbore environments exhibit thermal instability and, in some cases, permanent operational degradation.

DETAILED DESCRIPTION

Figure 1:
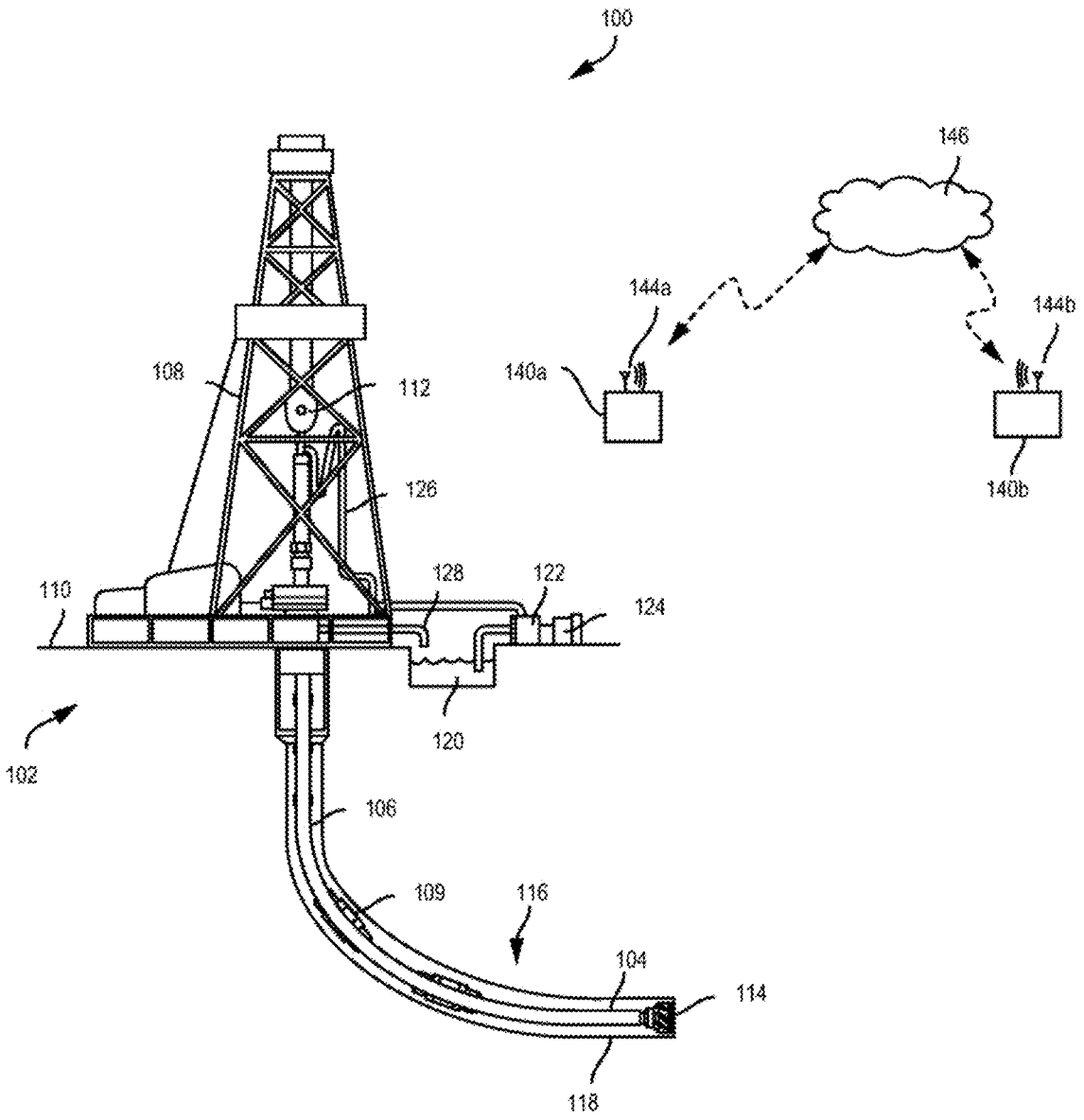
FIG. 1 is a cross-sectional side view of an example of a drilling system that includes an ultrasonic transducer according to one example of the present disclosure.

Certain aspects and examples of the present disclosure relate to an ultrasonic transducer having improved thermal stability for measuring characteristics in a wellbore. The ultrasonic transducer may be included in a sensor for performing geometrical measurements, for example, measuring the internal diameter of a casing, tubing or open borehole, and imaging in a wellbore during or subsequent to a drilling operation. An ultrasonic transducer according to some examples can include a connecting plate between piezoelectric material and a protective layer. The piezoelectric material can be formed into columns to improve transduction efficiency. The connecting plate, which may be epoxy-bonded between the piezoelectric material and the protective layer, can mitigate thermal stress on the ultrasonic transducer that is experienced by the ultrasonic transducer in a downhole environment. The connecting plate can be made of a material with a coefficient of thermal expansion (CTE) that is between the CTE of the piezoelectric material and the CTE of the connecting plate. The material of the connecting plate can also have an acoustic impedance that is between the acoustic impedance of the piezoelectric material and the acoustic impedance of the connecting plate.

An ultrasonic transducer according to some examples can include the protective layer positioned between the connecting plate and an acoustic medium that is drilling fluids, wellbore fluids, or other fluids that may be present downhole in a wellbore. The protective layer can protect the piezoelectric material from the acoustic medium. The protective layer may also acoustically match the piezoelectric material and the acoustic medium.

A piezoelectric material according to some examples can change dimensions in response to being stressed electrically by a voltage. The piezoelectric material can also generate an electric charge in response to being stressed mechanically by a force. And, a voltage associated with the electric charge can be sensed. A piezoelectric material can be a sensing element, a transmitting element, or both a sensing element and a transmitting element.

In some examples, the piezoelectric material is divided into columns of piezoelectric material. Each individual column can have a size that is smaller than the piezoelectric material layer as a whole. The columns can increase the energy transduction efficiency from electrical energy to mechanical energy based on the aspect ratio of the columns. The columns may also decrease noise caused by dimensional changes in the lateral direction of the piezoelectric material when it is excited. The lateral dimensional changes of the piezoelectric can be minimized due to the columns, and changes in the thickness direction of the piezoelectric material can be utilized for ultrasonic application.

When temperature increases, the epoxy bonding between the piezoelectric columns and the protective layer is subject to high thermal stress due to orders of magnitude difference between the CTE of the piezoelectric material and the protective layer. The connecting plate may be bonded, for example, using an epoxy, between the piezoelectric material and the protective layer of the ultrasonic transducer to mitigate the thermal stress induced by the high temperature borehole environment.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional side view of an example of a drilling system 100 in which an ultrasonic transducer according to some aspects of the present disclosure may operate. A wellbore of the type used to extract hydrocarbons from a formation may be created by drilling into the earth 102 using the drilling system 100. The drilling system 100 may be configured to drive a bottom hole assembly (BHA) 104 positioned or otherwise arranged at the bottom of a drillstring 106 extended into the earth 102 from a derrick 108 arranged at the surface 110. The BHA 104 may include a steering mechanism to enable adjustments to the drilling direction. For example, the steering mechanism may enable horizontal drilling of the wellbore. The derrick 108 includes a kelly 112 used to lower and raise the drillstring 106. The BHA 104 may include a drill bit 114 operatively coupled to a tool string 116, which may be moved axially within a drilled wellbore 118 as attached to the drillstring 106.

The tool string 116 may include one or more tool joints 109 which may further include sensors (not shown) for monitoring conditions in the wellbore, for example, but not limited to, rock porosity, absolute and relative permeabilities of formations, effective hydraulic diameter of the wellbore, etc. The ultrasonic transducer may be included in a logging tool of a wireline tool string 116 or a drill collar for a logging while drilling (LWD) tool or in the steering tool of the drillstring for measurement while drilling (MWD) to perform ultrasound measurements of the wellbore and the formation.

The combination of any support structure (in this example, derrick 108), any motors, electrical equipment, and support for the drillstring and tool string may be referred to herein as a drilling arrangement. Additional sensors (not shown) may be disposed on the drilling arrangement (e.g., on the wellhead) to monitor process parameters, for example, but not limited to, production fluid viscosity, density, etc. It should be appreciated that the parameters and conditions mentioned above do not form an exhaustive list and that other parameters and conditions may be monitored without departing from the scope of the present disclosure.

During operation, the drill bit 114 penetrates the earth 102 and thereby creates the wellbore 118. The BHA 104 provides control of the drill bit 114 as it advances into the earth 102. Drilling fluid, or "mud," from a mud tank 120 may be pumped downhole using a mud pump 122 powered by an adjacent power source, such as a prime mover or motor 124. The drilling fluid may be pumped from the mud tank 120, through a stand pipe 126, which feeds the drilling fluid into the drillstring 106 and conveys the drilling fluid to the drill bit 114. The drilling fluid exits one or more nozzles (not shown) arranged in the drill bit 114 and in the process cools the drill bit 114. After exiting the drill bit 114, the drilling fluid circulates back to the surface 110 via the annulus defined between the wellbore 118 and the drillstring 106, and in the process returns the drill cuttings and debris to the surface. The cuttings and drilling fluid mixture are passed through a flow line 128 and are processed such that a cleaned drilling fluid is returned downhole through the stand pipe 126 once again. Drilling fluid samples drawn from the mud tank 120 may be analyzed to determine the characteristics of the drilling fluid and any adjustments to the drilling fluid chemistry that should be made.

Sensors or instrumentation related to operating the drilling system 100 may be connected to a computing device 140*a*. In various implementations, the computing device 140*a* may be deployed in a work vehicle, may be permanently installed with the drilling system 100, may be handheld, or may be remotely located. In some examples, the computing device 140*a* may process at least a portion of the data received and may transmit the processed or unprocessed data to a remote computing device 140*b* via a wired or wireless network 146. The remote computing device 140*b* may be offsite, such as at a data-processing center. The remote computing device 140*b* may receive the data, execute computer program instructions to analyze the data, and communicate the analysis results to the computing device 140*a*.

Each of the computing devices 140*a*, 140*b* may include a processor interfaced with other hardware via a bus. A memory, which may include any suitable tangible (and non-transitory) computer-readable medium, such as RAM, ROM, EEPROM, or the like, can embody program components that configure operation of the computing devices 140*a*, 140*b*. In some aspects, the computing devices 140*a*, 140*b* may include input and output interface components (e.g., a display, printer, keyboard, touch-sensitive surface, and mouse) and additional storage.

The computing devices 140*a*, 140*b* may include communication devices 144*a*, 144*b*. The communication devices 144*a*, 144*b* may represent one or more components that facilitate a network connection. In the example shown in FIG. 1, the communication devices 144*a*, 144*b* are wireless and can include wireless interfaces such as IEEE 802.11, Bluetooth, or radio interfaces for accessing cellular telephone networks (e.g., transceiver and antenna for accessing a CDMA, GSM, UMTS, or other mobile communications network). In some examples, the communication devices 144*a*, 144*b* may use acoustic waves, surface waves, vibrations, optical waves, or induction (e.g., magnetic induction) for engaging in wireless communications. In other examples, the communication devices 144*a*, 144*b* may be wired and can include interfaces such as Ethernet, USB, IEEE 1394, or a fiber optic interface. The computing devices 140*a*, 140*b* may receive wired or wireless communications from one another and perform one or more tasks based on the communications.

Figure 2:
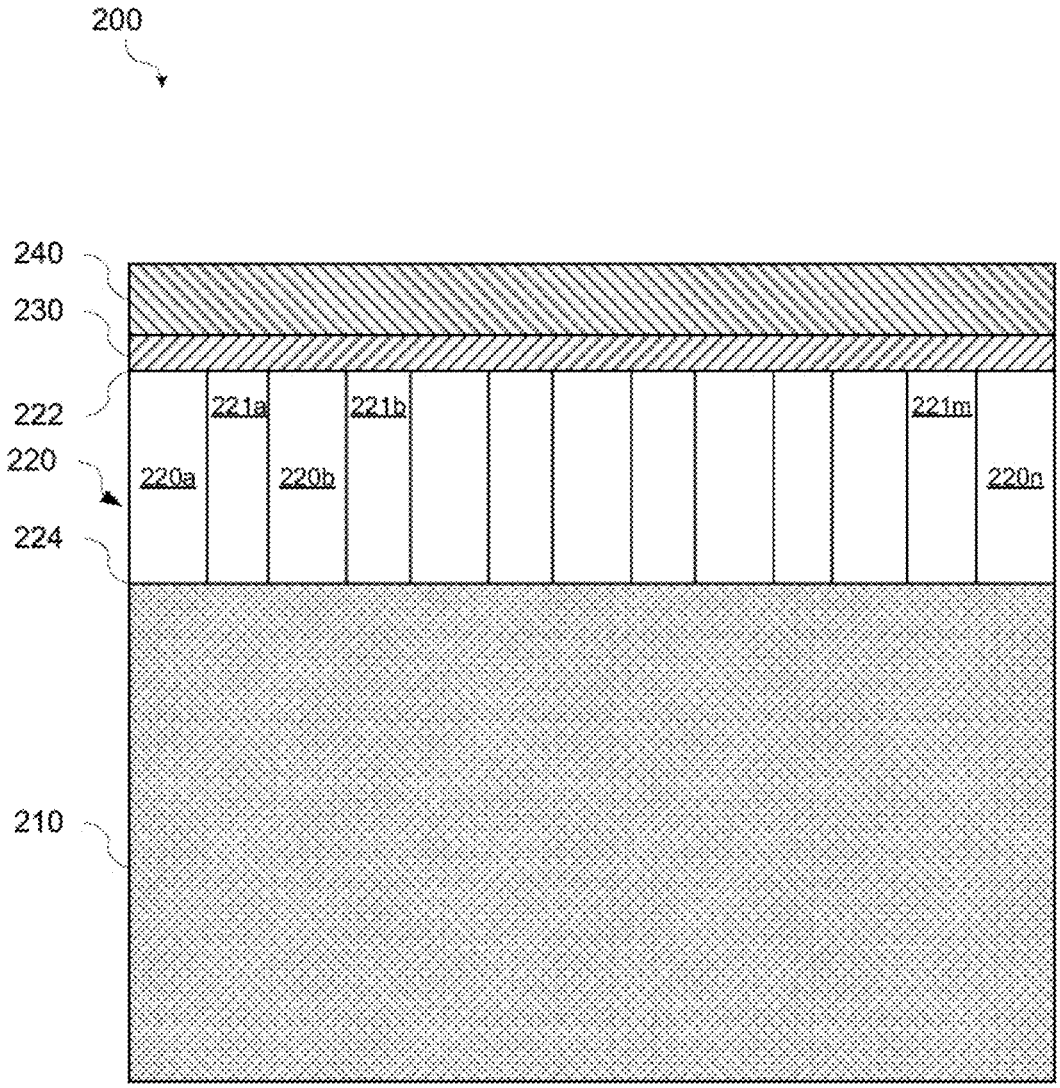
FIG. 2 is a cross-sectional view of an ultrasonic transducer according to one example of the present disclosure.

FIG. 2 is a cross-sectional view of an ultrasonic transducer 200 according to a first example of the present disclosure. The ultrasonic transducer 200 may include a backing layer 210, a piezoelectric material layer 220, a connecting plate 230, and a protective layer 240. The piezoelectric material layer 220 may be formed from piezoelectric ceramic materials, for example, but not limited to, lead zirconate titanate, lithium niobate, barium titanate, zinc oxide, etc.

The piezoelectric material layer 220 may be formed into a plurality of columns 220*a*-220*n*. Each column may be separated from adjacent columns by gaps 221*a*-221*m* in which piezoelectric material may be absent. The gaps 221*a*-221*m* in which piezoelectric material is absent may extend from the connecting plate 230 to the backing layer 210 disposed on a second surface 224 of the piezoelectric material layer 220. A first surface 222 of the piezoelectric material layer 220 in contact with the connecting plate 230 may be formed by the surfaces of each of the columns 220*a*-220*n*. Ultrasonic waves may propagate from the first surface 222 of the piezoelectric material layer 220 through the connecting plate 230 and the protective layer 240 into the acoustic medium. A second surface 224 of the piezoelectric material layer 220 in contact with the backing layer 210 may be formed by the opposite surfaces of each of the columns 220*a*-220*n*.

The connecting plate 230 may be disposed between the first surface 222 of the piezoelectric material layer 220 formed by the columns 220*a*-220*n* and the protective layer 240. In some implementations, the connecting plate 230 may be formed from a machinable glass-ceramic material, for example, Macor® or another machinable glass-ceramic material. In other implementations, the connecting plate 230 may be formed from glass, marble, or silicon. In some implementations, the connecting plate 230 may be formed from the same piezoelectric material used for the piezoelectric material layer 220.

The connecting plate 230 may have a coefficient of thermal expansion (CTE) in a range between the CTE of the piezoelectric material and the protective layer. The CTE of the connecting plate 230 can improve thermal stability of the ultrasonic transducer 200 when the ultrasonic transducer 200 is used in high temperature environments such as a wellbore. In some implementations, the CTE of the connecting plate 230 may be closer to the CTE of the columns 220*a*-220*n* of the piezoelectric material layer 220 than to the CTE of the protective layer 240. Since the columns of piezoelectric material have smaller bonding areas in comparison to a continuous layer of piezoelectric material, the CTE of the connecting plate 230 being closer to the CTE of the piezoelectric material can result in less thermal stress between the piezoelectric material columns 220*a*-220*n* and the connecting plate 230.

The connecting plate 230 may also have an acoustic impedance in a range between the acoustic impedance of the piezoelectric material and the protective layer. Providing a connecting plate 230 with an acoustic impedance in this range can maximize ultrasonic wave transmission from the piezoelectric material layer 220 to the protective layer 240 and into the acoustic medium.

The columns 220*a*-220*n* of the piezoelectric material layer 220 may be bonded to the connecting plate 230 at the first surface 222 of the piezoelectric material layer 220 using an epoxy, for example, but not limited to a silver epoxy or by another suitable method. Similarly, the columns 220*a*-220*n* of the piezoelectric material layer 220 may be bonded to the backing layer 210 using an epoxy, for example, but not limited to a silver epoxy or by another suitable method.

The protective layer 240 may be disposed over the connecting plate 230 to protect the piezoelectric material layer 220 and the connecting plate 230 from detrimental effects of the acoustic medium (e.g., drilling fluids and environmental fluids). The protective layer 240 may be formed from, for example, polyetheretherketone (PEEK), or another durable thermoplastic polymer or other material having mechanical strength, high temperature performance, and chemical resistance.

The backing layer 210 may be disposed on the second surface 224 of the piezoelectric material layer 220 opposite a first surface 222 from which ultrasonic waves propagate. The backing layer 210 may be configured to absorb ultrasonic waves propagating from the second surface 222 of the piezoelectric material layer 220.

In some implementations, the ultrasonic transducer 200 may include an additional protective film (not shown), for example, a film polytetrafluoroethylene (PTFE) or another material, disposed over the protective layer 240 to provide additional protection from the environment.

Figure 3:
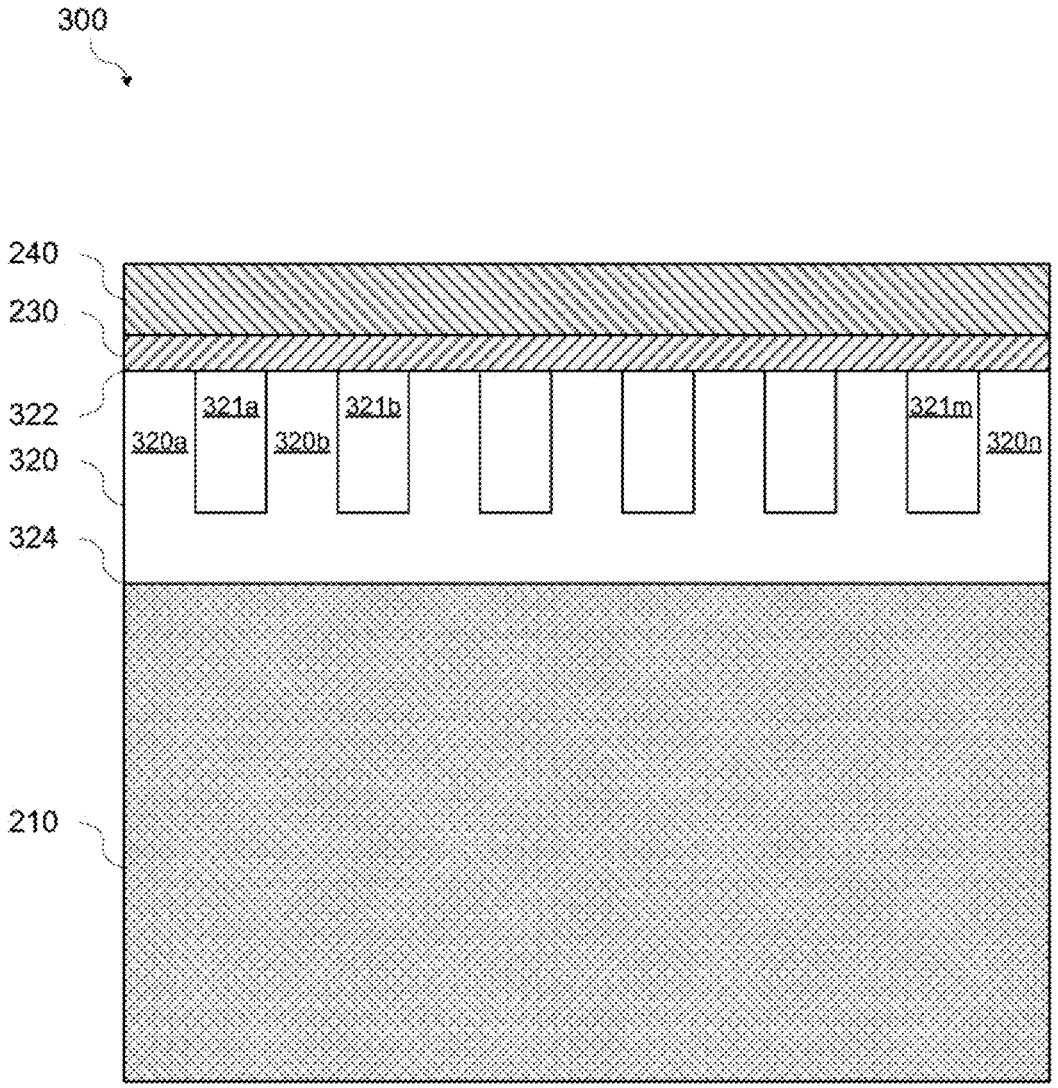
FIG. 3 is a cross-sectional view of an ultrasonic transducer according to another example of the present disclosure.

FIG. 3 is a cross-sectional view of an ultrasonic transducer 300 according to a second example of the present disclosure. In FIG. 3, the backing layer 210, the connecting plate 230, and the protective layer 240 of the ultrasonic transducer 300 have been described with respect to FIG. 2 and will not be further described here.

The piezoelectric material layer 320 of the ultrasonic transducer 300 may be formed from piezoelectric ceramic materials, for example, but not limited to, lead zirconate titanate, lithium niobate, barium titanate, zinc oxide, etc. The piezoelectric material layer 320 may be formed into a plurality of columns 320*a*-320*n*. Each column may be separated from adjacent columns by gaps 321*a*-321*m* in which piezoelectric material may be absent. The gaps 321*a*-321*m* in which piezoelectric material is absent may extend from the connecting plate 230 to a portion of the piezoelectric material layer 320 that is adjacent to the backing layer 210. A first surface 322 of the piezoelectric material layer 320 in contact with the connecting plate 230 may be formed by the surfaces of each of the columns 320*a*-320*n*. A second surface 324 of the piezoelectric material layer 320 may be in contact with the backing layer 210.

The columns 320*a*-320*n* of the piezoelectric material layer 320 may be bonded to the connecting plate 230 at the first surface 322 of the piezoelectric material layer 320 using an epoxy, for example, but not limited to a silver epoxy or by another suitable method. The second surface 324 of the piezoelectric material layer 320 may be bonded to the backing layer 210 using an epoxy, for example, but not limited to a silver epoxy or by another suitable method.

Figure 4:
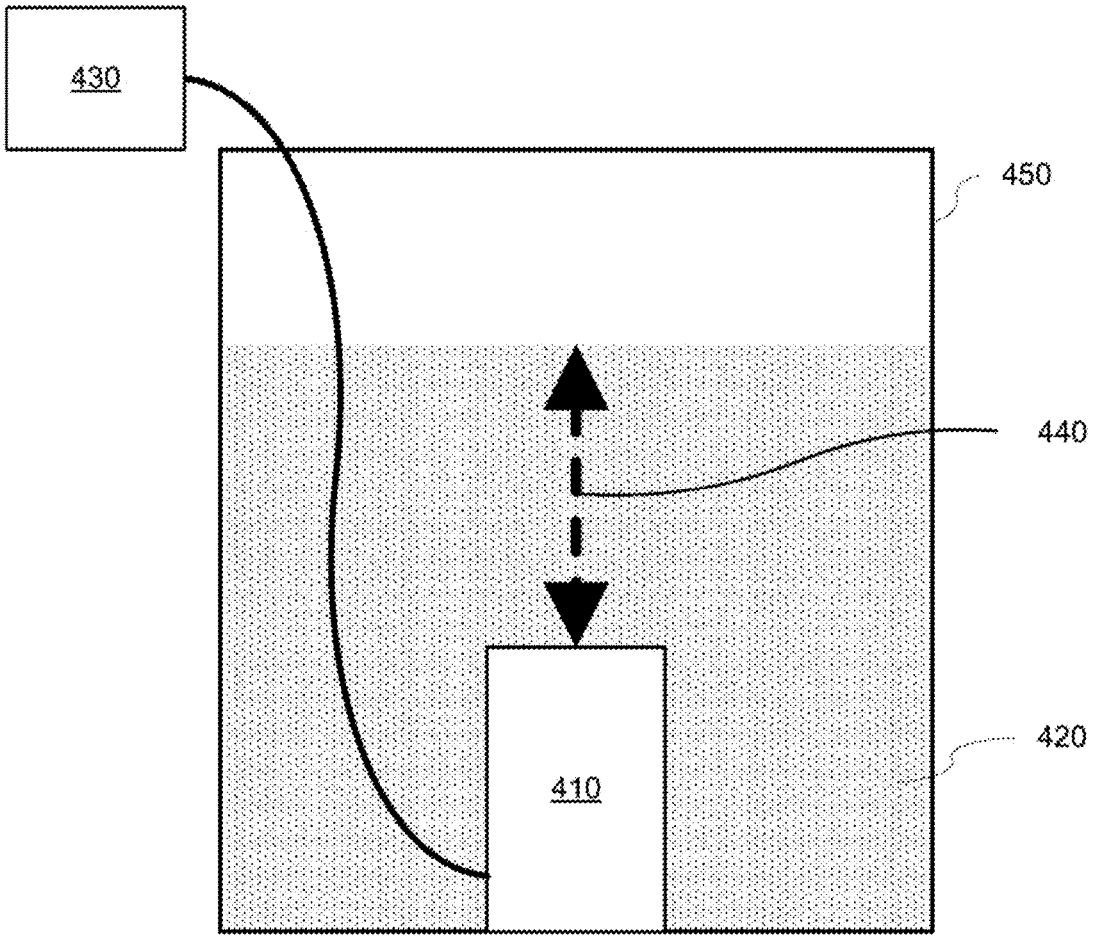
FIG. 4 is a diagram of a test set up used to generate plots of ultrasonic transducer signals according to one example of the present disclosure.
Figure 5:
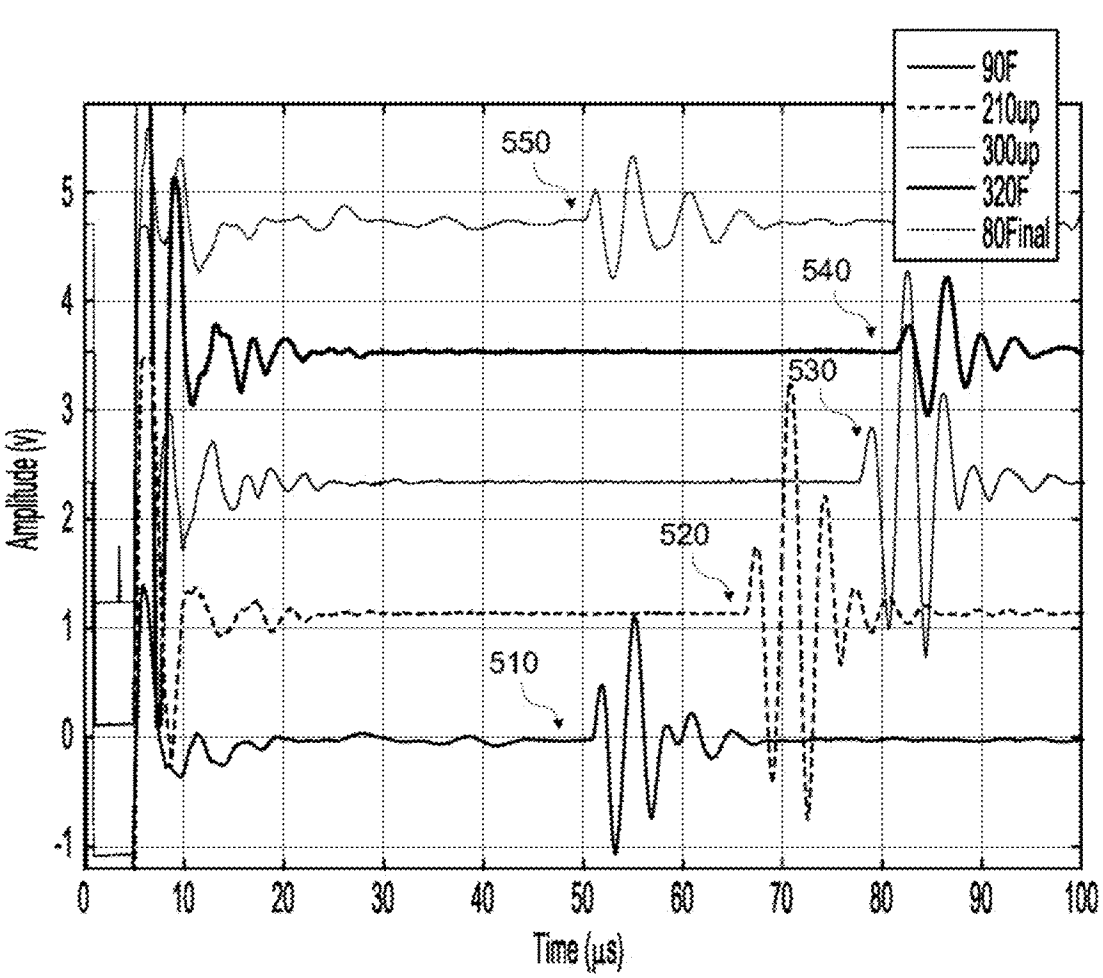
FIG. 5 is a series of plots illustrating ultrasonic transducer signals over temperature for a conventional ultrasonic transducer.
Figure 6:
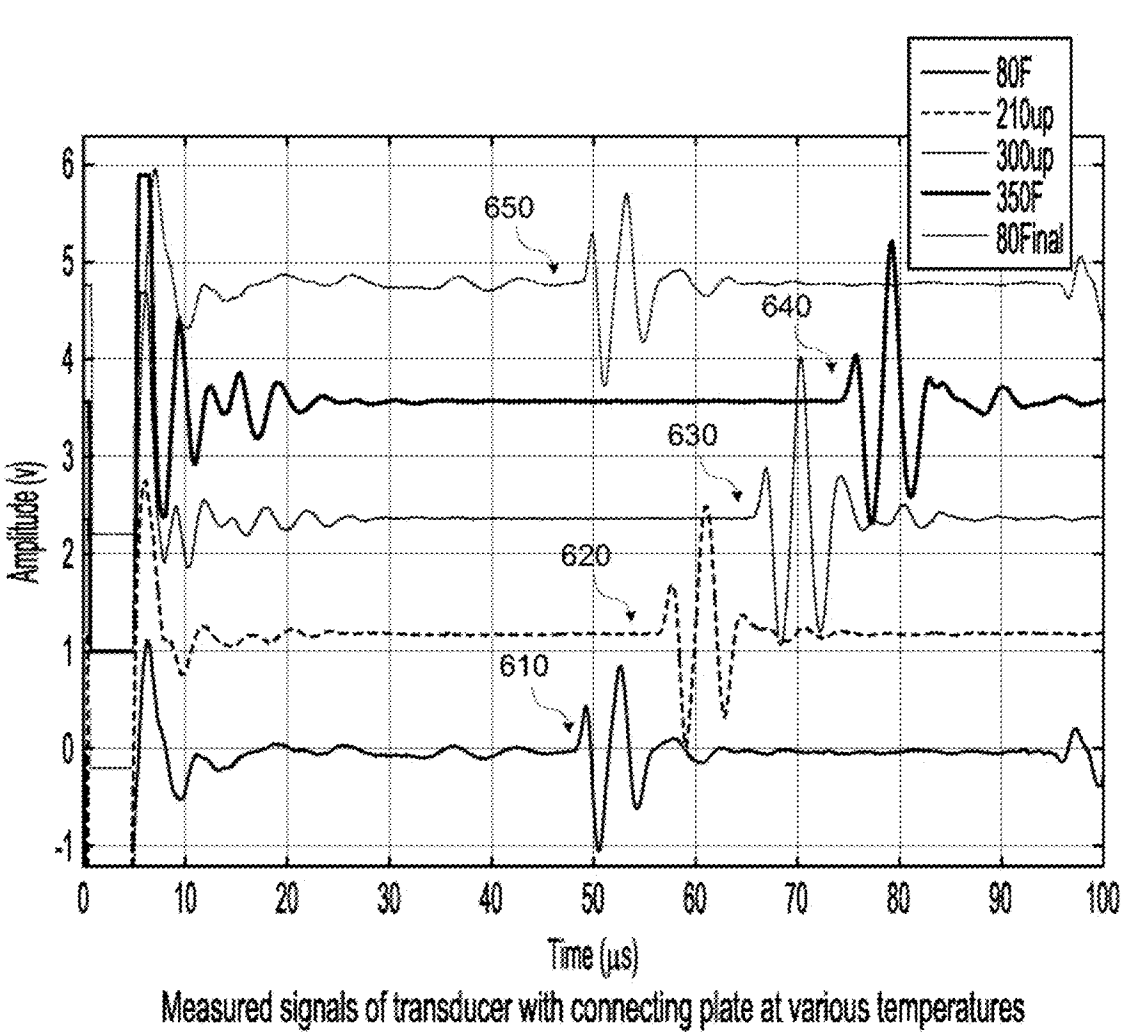
FIG. 6 is a series of plots illustrating ultrasonic transducer signals over temperature for an ultrasonic transducer according to one example of the present disclosure.

FIG. 4 is a diagram of a test set up used to generate plots of ultrasonic transducer signals illustrated in FIGS. 5 and 6. Referring to FIG. 4, a transducer 410 was submersed in a container 450 filled with an acoustic medium (e.g., silicon oil) 420. The container with the acoustic medium was heated in an oven. At known temperatures of the acoustic medium, the transducer was excited by a pulse-echo electronic system 430 to generate ultrasonic waves 440 that were reflected at the oil-air interface and received at the transducer.

FIG. 5 is a series of plots 500 illustrating ultrasonic transducer signals (e.g., echoes) over temperature for a conventional ultrasonic transducer (i.e., an ultrasonic transducer without a connecting plate). The plots were obtained at various temperatures using the test set up of FIG. 4. The plots of the transducer signals were obtained at sequentially increasing temperatures of the acoustic medium starting from an initial temperature. A final transducer signal was obtained after the acoustic medium had cooled to a temperature near the initial temperature.

As illustrated in FIG. 5, at an initial temperature of approximately 90° F. (32° C.), the transducer signal 510 returned an echo having a magnitude of approximately 2 volts peak-to-peak. At an increased temperature of 210° F. (100° C.), the amplitude of the echo 520 approximately doubled, and at a temperature of 300° F. (150° C.), the amplitude of the echo 530 remained approximately the same. At a temperature of 320° F. (160° C.), the amplitude of the echo 540 decreased to about 1 volt. It should be noted that the signal response time increases as temperature increases due to a decrease in the speed of sound in oil with an increase in temperature.

A final plot of the transducer signal 550 was obtained after the acoustic medium was cooled to approximately 80° F. (27° C.). As can be seen by comparing the initial plot of the transducer signal 510 with the final plot of the transducer signal 550 at comparable temperatures, the amplitude of the echo shown in the final plot of the transducer signal 550 had decreased by about half the amplitude of the initial plot of the transducer signal 510 indicating a permanent degradation in acoustic performance of the conventional transducer.

FIG. 6 is a series of plots 600 illustrating ultrasonic transducer signals over temperature for an ultrasonic transducer according to one example of the present disclosure. The plots were obtained at substantially the same temperatures as in FIG. 5 using the test set up of FIG. 4. An initial plot 610 having an amplitude of approximately 2 volts peak-to-peak was obtained at 80° F. (27° C.). Plots obtained at 210° F. (100° C.) (520), 300° F. (150° C.) (530), and 350° F. (160° C.) (540) show increasing echo amplitudes over the initial echo amplitude of approximately 2 volts peak-to-peak. A final plot 650 was obtained after the acoustic medium was cooled to approximately 80° F. (27° C.). As can be seen by comparing the initial plot 610 with the final plot 650 at comparable temperatures, the amplitude of the echo shown in the final plot 650 is substantially the same as the amplitude of the echo for the initial plot 610, demonstrating the thermal stability of the transducer fabricated according to the present disclosure.

Figure 7:
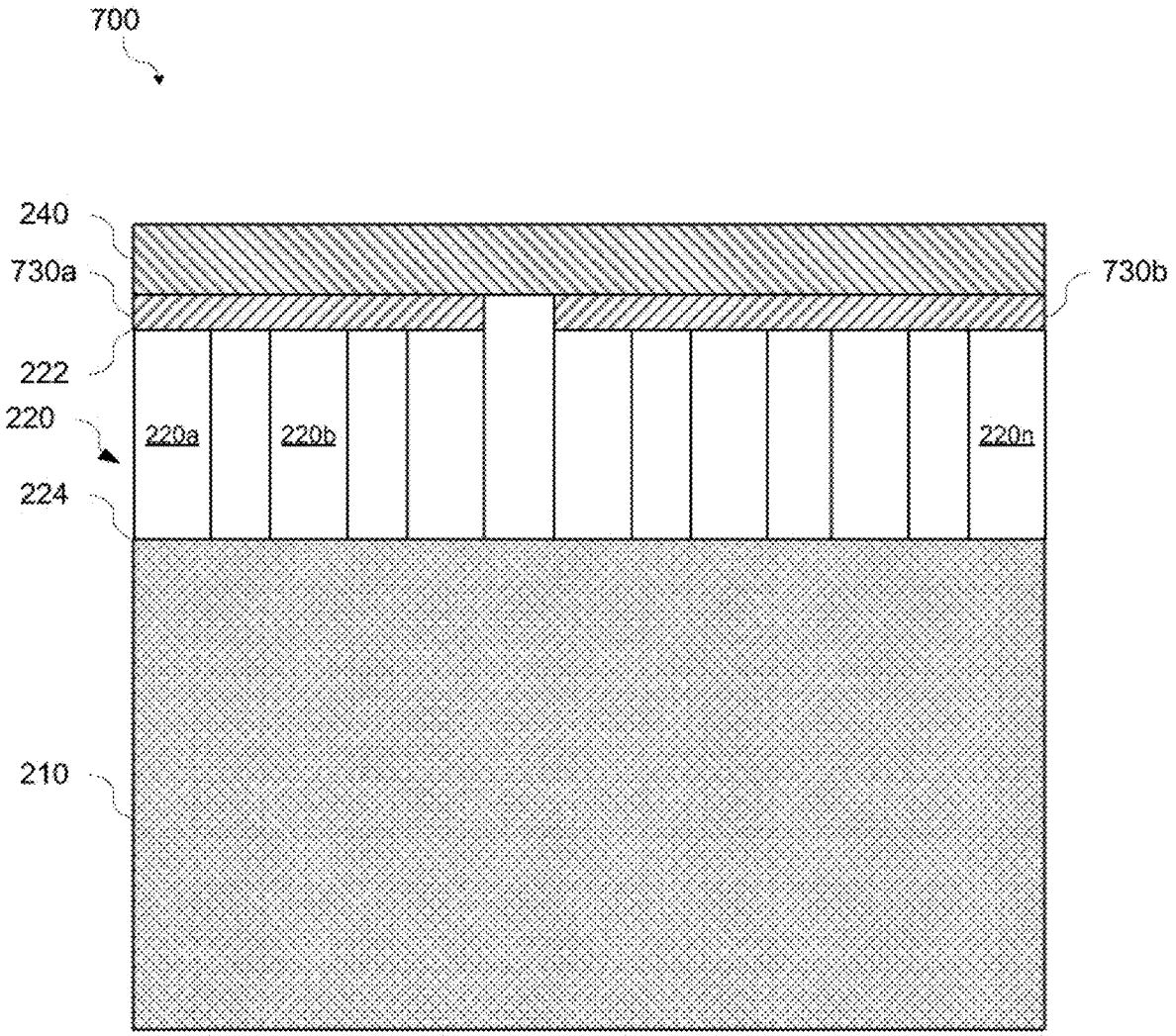
FIG. 7 is a cross-sectional view of an ultrasonic transducer according to a further example of the present disclosure.

FIG. 7 is a cross-sectional view of an ultrasonic transducer 700 according to a third example of the present disclosure. In FIG. 7, the backing layer 210, the piezoelectric material layer 220, and the protective layer 240 of the ultrasonic transducer 700 have been described with respect to FIG. 2 and will not be further described here.

As illustrated in FIG. 7, a multipiece connecting plate 730*a*-730*b* may be disposed between the first surface 222 of the piezoelectric material layer 220 formed by the columns 220*a*-220*n* and the protective layer 240. In some implementations, the connecting plate 230 may be formed from a machinable glass-ceramic material, for example, Macor® or another machinable glass-ceramic material. In other implementations, the multipiece connecting plate 730*a*-730*b* may be formed from glass, marble, or silicon. In some implementations, the multipiece connecting plate 730*a*-730*b* may be formed from the same piezoelectric material used for the piezoelectric material layer 220.

While the multipiece connecting plate 730*a*-730*b* illustrated in FIG. 7 includes two pieces, in various embodiments the multipiece connecting plate may include more than two pieces. Each piece of the multipiece connecting plate may be bonded to the same number of columns of the piezoelectric material layer or may be bonded to a different number of columns of the piezoelectric material layer. For example, each piece of the multipiece connecting plate may be bonded to a different set of columns of the plurality of columns 220*a*-220*n*, and each set of columns may or may not include a same number of columns.

The multipiece connecting plate 730*a*-730*b* may have a coefficient of thermal expansion (CTE) in a range between the CTE of the piezoelectric material and the protective layer. The CTE of the multipiece connecting plate 730*a*-730*b* can improve thermal stability of the ultrasonic transducer 700 when the ultrasonic transducer 700 is used in high temperature environments such as a wellbore. In some implementations, the CTE of the multipiece connecting plate 730*a*-730*b* may be closer to the CTE of the columns 220*a*-220*n* of the piezoelectric material layer 220 than to the CTE of the protective layer 240. Since the columns of piezoelectric material have smaller bonding areas in comparison to a continuous layer of piezoelectric material, the CTE of the multipiece connecting plate 730*a*-730*b* being closer to the CTE of the piezoelectric material can result in less thermal stress between the piezoelectric material columns 220*a*-220*n* and the connecting plate 230. The multipiece connecting plate 730*a*-730*b* may further reduce thermal stress between the piezoelectric material columns 220*a*-220*n* and the multipiece connecting plate 730*a*-730*b* as compared to the connecting plate 230.

Figure 8:
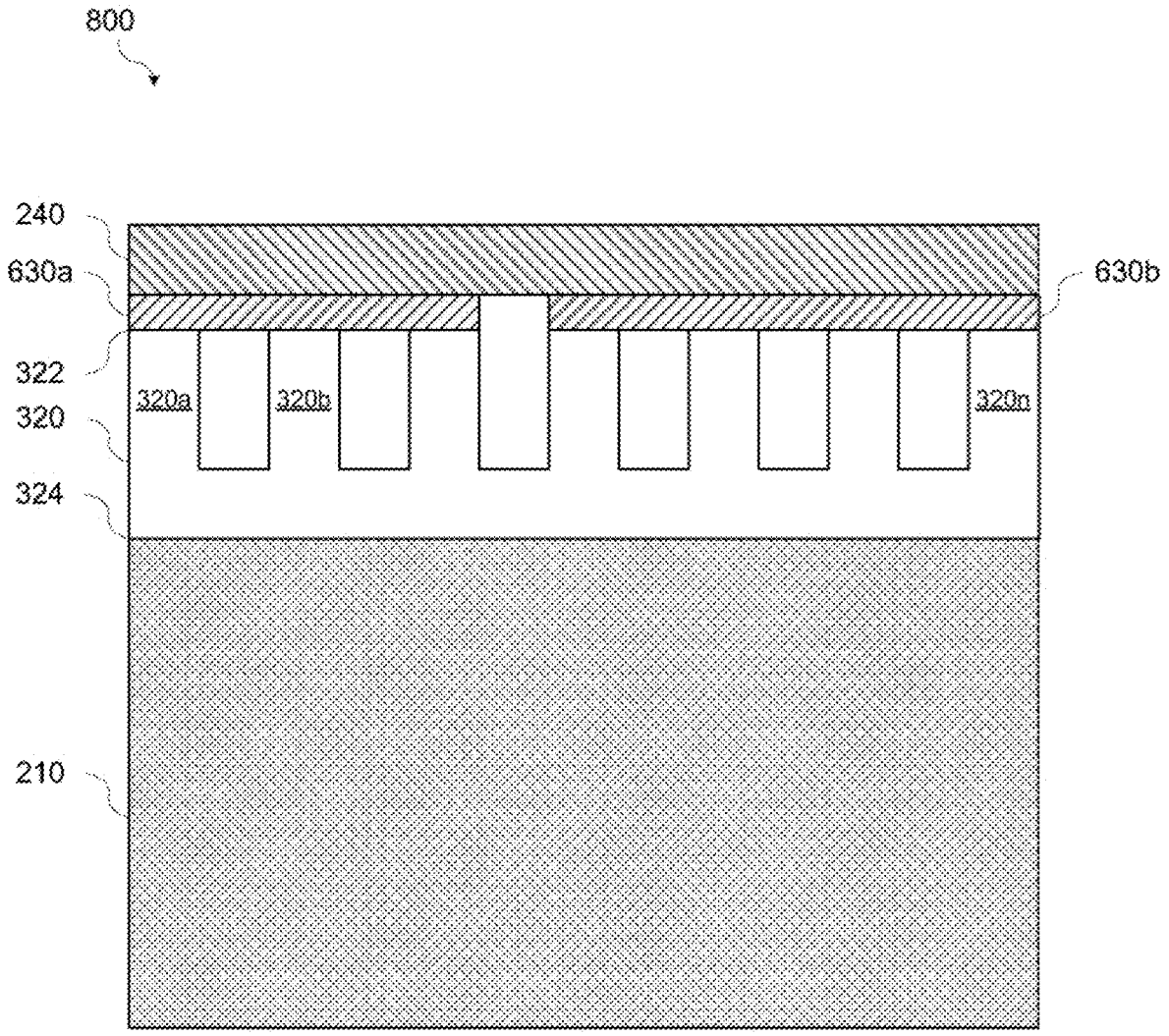
FIG. 8 is a cross-sectional view of an ultrasonic transducer according to another example of the present disclosure.

FIG. 8 is a cross-sectional view of an ultrasonic transducer 800 according to a fourth example of the present disclosure. The fourth example of the ultrasonic transducer 800 may include a backing layer 210, a piezoelectric material layer 320, a multipiece connecting plate 730*a*-730*b*, and a protective layer 240. In FIG. 8, the backing layer 210 and the protective layer 240 of the ultrasonic transducer 800 have been described with respect to FIG. 2, the piezoelectric material layer 320 has been described with respect to FIG. 3, and the multipiece connecting plate 730*a*-730*b* has been described with respect to FIG. 7. These elements will not be further described here.

In some aspects, apparatuses, systems, and methods for measuring characteristics of a wellbore in a drilling operation using an ultrasonic transducer are provided according to one or more of the following examples:

Example 1 is an ultrasonic transducer positionable in a wellbore environment, the ultrasonic transducer including a piezoelectric material layer having a plurality of columns of piezoelectric material for detecting a characteristic of the wellbore environment during a drilling operation; a protective layer positionable between the piezoelectric material layer and an acoustic medium in the wellbore environment to pass ultrasound waves into the acoustic medium; and a connecting plate positioned between the piezoelectric material layer and the protective layer, the connecting plate being bonded to at least some columns of the plurality of columns of the piezoelectric material layer, the connecting plate including a material having (i) a coefficient of thermal expansion (CTE) in a range between the CTE of the piezoelectric material layer and the CTE of the protective layer, and (ii) an acoustic impedance in a range between the acoustic impedance of the piezoelectric material layer and the acoustic impedance of the protective layer.

Example 2 is the ultrasonic transducer of example 1, further including a backing material layer positioned on an opposite surface of the piezoelectric material layer from the connecting plate to absorb ultrasonic waves propagating from the opposite surface of the piezoelectric material layer.

Example 3 is the ultrasonic transducer of examples 1 and 2, wherein the CTE of the connecting plate is closer to the CTE of the piezoelectric material layer than to the CTE of the protective layer.

Example 4 is the ultrasonic transducer of examples 1-3, wherein each of the plurality of columns is separated from adjacent columns by a gap in which piezoelectric material is absent.

Example 5 is the ultrasonic transducer of examples 1-4, wherein the gap in which piezoelectric material is absent extends from the connecting plate to a backing material layer positioned on an opposite surface of the piezoelectric material layer from the connecting plate.

Example 6 is the ultrasonic transducer of examples 1-5, wherein the connecting plate includes multiple separate portions, each portion being bonded to a different subset of the plurality of columns.

Example 7 is the ultrasonic transducer of examples 1-6, wherein the connecting plate includes a material selected from the group of glass, glass-ceramic, marble, and silicon.

Example 8 is the ultrasonic transducer of examples 1-7, the ultrasonic transducer being operable to convert electric pulses into ultrasonic pulses, and convert ultrasonic pulse echoes received from portions of the wellbore into electric signals, the electrical signals being interpretable as a diameter or an image of a portion of the wellbore.

Example 9 is a system including a toolstring positionable in a wellbore for delivering sensors downhole in the wellbore; and an ultrasonic transducer contained in the toolstring to convert electric pulses into ultrasonic pulses, and convert received ultrasonic pulse echoes into electric signals, the ultrasonic transducer including a piezoelectric material layer having a plurality of columns of piezoelectric material for detecting a characteristic of the wellbore during a drilling operation; a protective layer positionable between the piezoelectric material layer and an acoustic medium in the wellbore; and a connecting plate positioned between the piezoelectric material layer and the protective layer, the connecting plate being bonded to at least some of the columns of the piezoelectric material layer, the connecting plate including a material having (i) a coefficient of thermal expansion (CTE) in a range between the CTE of the piezoelectric material layer and the CTE of the protective layer, wherein the CTE of the connecting plate is closer to the CTE of the piezoelectric material layer than to the CTE of the protective layer, and (ii) an acoustic impedance in a range between the acoustic impedance of the piezoelectric material layer and the acoustic impedance of the protective layer.

Example 10 is the system of example 9, wherein the ultrasonic transducer further includes a backing material layer positioned on an opposite surface of the piezoelectric material layer from the connecting plate to absorb ultrasonic waves propagating from the opposite surface of the piezoelectric material layer.

Example 11 is the system of examples 9 and 10, wherein each of the plurality of columns is separated from adjacent columns by a gap in which piezoelectric material is absent.

Example 12 is the system of examples 9-11, wherein the gap in which piezoelectric material is absent extends from the connecting plate to a backing material layer positioned on an opposite surface of the piezoelectric material layer from the connecting plate.

Example 13 is the system of examples 9-12, wherein the connecting plate includes multiple separate portions, each portion being bonded to a different subset of the plurality of columns.

Example 14 is the system of examples 9-13, wherein the connecting plate includes a material selected from the group of glass, glass-ceramic, marble, and silicon.

Example 15 is a method for measuring conditions in a wellbore using an ultrasonic transducer, including providing the ultrasonic transducer downhole in the wellbore on a toolstring to a position at which an acoustic medium is present in the wellbore, the ultrasonic transducer including a piezoelectric material layer having a plurality of columns of piezoelectric material for detecting a characteristic of the wellbore during a drilling operation; a protective layer positioned between the piezoelectric material layer and the acoustic medium in the wellbore to pass ultrasound waves into the acoustic medium; and a connecting plate positioned between the piezoelectric material layer and the protective layer, the connecting plate being bonded to at least some of the plurality of columns of the piezoelectric material layer, the connecting plate including a material having (i) a coefficient of thermal expansion (CTE) in a range between the CTE of the piezoelectric material layer and the CTE of the protective layer, and (ii) an acoustic impedance in a range between the acoustic impedance of the piezoelectric material layer and the acoustic impedance of the protective layer; generating ultrasonic waves by providing electrical signals to the ultrasonic transducer, receiving, via the acoustic medium, echoes of the ultrasonic waves reflected from portions of the wellbore by the ultrasonic transducer; and transmitting electrical signals corresponding to the echoes of the ultrasonic waves to instrumentation positioned at a surface of the wellbore.

Example 16 is the method of example 15, wherein the ultrasonic transducer further includes a backing material layer positioned on an opposite surface of the piezoelectric material layer from the connecting plate, the backing material layer configured to absorb ultrasonic waves propagating from the opposite surface of the piezoelectric material layer.

Example 17 is the method of examples 15 and 16, wherein the CTE of the connecting plate of the ultrasonic transducer is closer to the CTE of the piezoelectric material layer than to the CTE of the protective layer.

Example 18 is the method of examples 15-17, wherein each of the plurality of columns of piezoelectric material of the ultrasonic transducer is separated from adjacent columns by a gap in which piezoelectric material is absent.

Example 19 is the method of examples 15-18, wherein the connecting plate of the ultrasonic transducer comprises multiple separate portions, each portion being bonded to a different subset of the plurality of columns.

Example 20 is the method of examples 15-19, wherein the ultrasonic transducer is operable to convert electric pulses into ultrasonic pulses, and convert ultrasonic pulse echoes received from portions of the wellbore into electric signals, the electrical signals being interpretable as a diameter or an image of a portion of the wellbore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An ultrasonic transducer positionable in a wellbore environment, the ultrasonic transducer comprising:

a piezoelectric material layer comprising a plurality of columns of piezoelectric material for detecting a characteristic of the wellbore environment during a drilling operation;

a protective layer positionable between the piezoelectric material layer and an acoustic medium in the wellbore environment to pass ultrasound waves into the acoustic medium; and a connecting plate being formed from a machinable glass-ceramic material, the connecting plate being positioned between the piezoelectric material layer and the protective layer, the connecting plate being bonded to at least some columns of the plurality of columns of the piezoelectric material layer, the connecting plate including a material having (i) a coefficient of thermal expansion (CTE) in a range between the CTE of the piezoelectric material layer and the CTE of the protective layer, and (ii) an acoustic impedance in a range between the acoustic impedance of the piezoelectric material layer and the acoustic impedance of the protective layer.

2. The ultrasonic transducer of claim 1, further comprising:

a backing material layer positioned on an opposite surface of the piezoelectric material layer from the connecting plate to absorb ultrasonic waves propagating from the opposite surface of the piezoelectric material layer.

3. The ultrasonic transducer of claim 1, wherein the CTE of the connecting plate is closer to the CTE of the piezoelectric material layer than to the CTE of the protective layer.

4. The ultrasonic transducer of claim 1, wherein each of the plurality of columns is separated from adjacent columns by a gap in which piezoelectric material is absent.

5. The ultrasonic transducer of claim 4, wherein the gap in which piezoelectric material is absent extends from the connecting plate to a backing material layer positioned on an opposite surface of the piezoelectric material layer from the connecting plate.

6. The ultrasonic transducer of claim 1, wherein the connecting plate comprises multiple separate portions, each portion being bonded to a different subset of the plurality of columns.

7. The ultrasonic transducer of claim 1 being operable to convert electric pulses into ultrasonic pulses, and convert ultrasonic pulse echoes received from portions of the wellbore into electric signals, the electrical signals being interpretable as a diameter or an image of a portion of the wellbore.

8. A system comprising:

a toolstring positionable in a wellbore for delivering sensors downhole in the wellbore; and an ultrasonic transducer contained in the toolstring to convert electric pulses into ultrasonic pulses, and convert received ultrasonic pulse echoes into electric signals, the ultrasonic transducer comprising:

a piezoelectric material layer comprising a plurality of columns of piezoelectric material for detecting a characteristic of the wellbore during a drilling operation;

a protective layer positionable between the piezoelectric material layer and an acoustic medium in the wellbore; and a connecting plate being formed from a machinable glass-ceramic material, the connecting plate being positioned between the piezoelectric material layer and the protective layer, the connecting plate being bonded to at least some of the columns of the piezoelectric material layer, the connecting plate including a material having (i) a coefficient of thermal expansion (CTE) in a range between the CTE of the piezoelectric material layer and the CTE of the protective layer, wherein the CTE of the connecting plate is closer to the CTE of the piezoelectric material layer than to the CTE of the protective layer, and (i) an acoustic impedance in a range between the acoustic impedance of the piezoelectric material layer and the acoustic impedance of the protective layer.

9. The system of claim 8, wherein the ultrasonic transducer further comprises:

a backing material layer positioned on an opposite surface of the piezoelectric material layer from the connecting plate to absorb ultrasonic waves propagating from the opposite surface of the piezoelectric material layer.

10. The system of claim 8, wherein each of the plurality of columns is separated from adjacent columns by a gap in which piezoelectric material is absent.

11. The system of claim 10, wherein the gap in which piezoelectric material is absent extends from the connecting plate to a backing material layer positioned on an opposite surface of the piezoelectric material layer from the connecting plate.

12. The system of claim 8, wherein the connecting plate comprises multiple separate portions, each portion being bonded to a different subset of the plurality of columns.

13. A method for measuring conditions in a wellbore using an ultrasonic transducer, the method comprising:

providing the ultrasonic transducer downhole in the wellbore on a toolstring to a position at which an acoustic medium is present in the wellbore, the ultrasonic transducer comprising:

a piezoelectric material layer comprising a plurality of columns of piezoelectric material for detecting a characteristic of the wellbore during a drilling operation;

a protective layer positioned between the piezoelectric material layer and the acoustic medium in the wellbore to pass ultrasound waves into the acoustic medium; and a connecting plate being formed from a machinable glass-ceramic material, the connecting plate being positioned between the piezoelectric material layer and the protective layer, the connecting plate being bonded to at least some of the plurality of columns of the piezoelectric material layer, the connecting plate including a material having (i) a coefficient of thermal expansion (CTE) in a range between the CTE of the piezoelectric material layer and the CTE of the protective layer, and (ii) an acoustic impedance in a range between the acoustic impedance of the piezoelectric material layer and the acoustic impedance of the protective layer;

generating ultrasonic waves by providing electrical signals to the ultrasonic transducer, receiving, via the acoustic medium, echoes of the ultrasonic waves reflected from portions of the wellbore by the ultrasonic transducer; and transmitting electrical signals corresponding to the echoes of the ultrasonic waves to instrumentation positioned at a surface of the wellbore.

14. The method of claim 13, wherein the ultrasonic transducer further comprises:

a backing material layer positioned on an opposite surface of the piezoelectric material layer from the connecting plate, the backing material layer configured to absorb ultrasonic waves propagating from the opposite surface of the piezoelectric material layer.

15. The method of claim 13, wherein the CTE of the connecting plate of the ultrasonic transducer is closer to the CTE of the piezoelectric material layer than to the CTE of the protective layer.

16. The method of claim 13, wherein each of the plurality of columns of piezoelectric material of the ultrasonic transducer is separated from adjacent columns by a gap in which piezoelectric material is absent.

17. The method of claim 13, wherein the connecting plate of the ultrasonic transducer comprises multiple separate portions, each portion being bonded to a different subset of the plurality of columns.

18. The method of claim 13, wherein the ultrasonic transducer is operable to convert electric pulses into ultrasonic pulses, and convert ultrasonic pulse echoes received from portions of the wellbore into electric signals, the electrical signals being interpretable as a diameter or an image of a portion of the wellbore.

* * * * *